US005440959A

United States Patent [19]

Bindon et al.

[11] Patent Number: 5,440,959

[45] Date of Patent: Aug. 15, 1995

[54] COLLAPSIBLE BREAD SLICING APPLIANCE WITH ELECTRIC FAN

[76] Inventors: John N. Bindon, 1168 Cranberry Ave.; Thomas R. Parks, 1289 Mandarin Dr., both of Sunnyvale, Calif. 94087

[21] Appl. No.: 152,844

[22] Filed: Nov. 15, 1993

[51] Int. Cl.[6] ..... B26D 7/02; B26D 7/18

[52] U.S. Cl. ..... 83/100; 83/167; 83/454; 83/467.1; 83/762

[58] Field of Search ..... 83/98, 100, 454, 455, 83/467.1, 761, 762, 763, 764, 765, 167

[56] References Cited

U.S. PATENT DOCUMENTS

| | | | |
|---|---|---|---|
| 179,934 | 7/1876 | Merwin | 83/762 |
| 1,822,581 | 9/1931 | Brown | 83/466.1 |
| 1,867,993 | 7/1932 | Tuttle | 83/762 |
| 2,398,192 | 4/1946 | Scheminger | 83/762 |
| 4,085,642 | 4/1978 | Birmingham | 83/764 |
| 4,964,323 | 10/1990 | Fortney | 83/467.1 X |
| 5,090,286 | 2/1992 | Ward | 83/761 |
| 5,115,704 | 5/1992 | Hyman | 83/764 |

*Primary Examiner*—Richard K. Seidel
*Assistant Examiner*—Clark F. Dexter

[57] ABSTRACT

A bread slicing guide appliance that supports and holds bread loaves of varying sizes while providing guidance and alignment to the slicing knife as well as collection and retention of the bread crumb debris as it is created during slicing. Debris collection and retention is accomplished by virtue of the open matrix design of the support grid, the filter screen and the downward flow of air created by the aspiration fan and electric motor mounted in the base housing. In addition the base housing shell may be unlatched from the base and pivoted upward and away, allowing easy cleaning of the base housing. When the device is not in use a novel approach for compact storage is incorporated in the fold-down design.

3 Claims, 4 Drawing Sheets

COLLAPSIBLE BREAD SLICING APPLIANCE WITH ELECTRIC FAN

BACKGROUND

1. Field of Invention

This invention relates to a bread slicing appliance that is especially designed for home kitchen use, providing a movable slicing guide that will accommodate variable loaf size, motorized fan aspiration and collection of bread crumb debris, and a geometric arrangement of components that provides a compact storage envelope.

This invention resulted from research to develop and evaluate small scale food processing equipment for use in space applications which involved a wide range of gravity conditions. As a result of the bread crumb debris created during bread slicing a positive method of capture and retention was needed. Particulate contamination in the breathable atmosphere in a space module is a critical crew safety issue. Extending this concept of particulate aspiration and retention to an Earth-based kitchen appliance was a natural progression.

2. Description of Prior Art

Several attempts have been made in the past to produce an efficient bread slicing device with varying degrees of success. The ability to provide adequate support for the bread loaf and guidance of the slicing knife, however, is only part of the task. None of the devices reviewed in the course of this investigation provided any accommodation for acquisition and containment of the debris that is generated in the slicing process.

U.S. Pat. No. 179,934, issued Jul. 18, 1876 to Merwin disclosed a rectangular case with slots in the sides thereby providing support to the loaf and slicing knife guidance. Use of this device required pre-cutting or sizing the loaf to fit the case. Bread at that time was baked in a variety of sizes and shapes.

Similarly, U.S. Pat. No. 1,822,581 issued to Brown Sep. 8, 1931, provided slicing guides without provision for loaves of varying size. U.S. Pat. No. 1,867,993 issued to Tuttle on Jul. 19, 1932 provided loaf support and knife guidance heretofore embodied in previous inventions and additionally provided some accommodation for loaf variability through flexible side guides fabricated from thin sheet stock. In U.S. Pat. No. 2,398,192 issued to Scheminger on Apr. 9, 1946 slicing guides of similar design to the subject invention were utilized with varying spaces that allowed variable thickness in slices. In addition an end stop was provided to support the completed slice similar to the subject invention. The slicing guides were also pivoted by hinge to allow flat storage, However, with the end stop in place the slicing guides become rigid with no allowance for tilting toward the loaf and thus holding a variable sized loaf in place. In U.S. Pat. No. 4,085,642 issued to Birmingham on Apr. 25, 1978, loaf variability was accommodated by provision of several grooves in the base plate that permitted alternate positions for the slicing guides. As a result of this adjust ability feature it would appear that little or no lateral holding force could be applied to the loaf during slicing. As an alternative an end position slide was added to hold the loaf in position. More recently in U.S. Pat. No. 5,090,286 issued to Ward, Feb. 25, 1992, a device offered simplified construction and device storage by virtue of a fold down wire bail that doubled as a slicing guide and a carrying handle. This device eliminated all loaf holding capability and true knife guidance. Only one wire guide was provided therefore the slicing knife is only partially guided. Retention of the loaf is left to a hand hold method. Again on May 26, 1992 U.S. Pat. No. 5,115,704 was issued to Hyman for a very similar device wherein slicing guides were inserted in a series of grooves in a base plate, thus allowing for variable loaf size. In this instance no end stop was included so the operator must place the loaf in position by guesswork. Also, no side pressure in clamping the loaf was included since the slicing guides were rigidly held in close fitting slots. One additional feature was added, that being the cavity in the base that serves as a collector of crumbs. This collector depends upon gravity to cause the crumbs to find their way into the collector cavity and made no provision for crumb dynamics in slicing.

SUMMARY OF THE INVENTION

This invention represents an innovative bread slicing appliance that will accommodate bread loaves of varying sizes, provides more complete slicing knife guidance, provides a means of bread crumb aspiration, collection and easy cleaning, positive lateral loaf holding during slicing, end stop positioning of the loaf thereby holding the slices and preventing slice peel-off prior to the completion of the slicing action, and simple component fold-down for compact device storage.

Basically, the invention comprises a base housing which contains an electric motor with a fan. Above the fan and fixed in the downward airflow path is a filter screen which is held in place by an open-grid platform. This platform serves as the support for the loaf during slicing. Attached to the base housing through hinges are the two slicing guides. The primary guide is hinged in such a way that it becomes rigid when upright. The secondary guide is hinged in such a way that it is free to tilt toward the loaf and thus provide a positive lateral holding force during slicing. Both slicing guides have 3 matching slots which provide alignment to the slicing knife. When the device is not in use, innovative fold down design features minimize storage space required. Rubber feet are provided under the base housing to stabilize the device while being used and to prevent scratching or marking the supporting counter top.

Objects and Advantages:

Accordingly, several objects and advantages of our invention are:

(a) to provide a means of applying hand clamping pressure to the side of a variable size loaf by hinging the secondary slicing guide for lateral inward motion.

(b) to provide a primary slicing guide that is hinged into a fixed operating position to absorb the lateral cutting force of the slicing motion.

(c) to provide a positive motorized air flow through the support grid into the vented base housing thus aspirating and capturing crumb debris as it is created.

(d) to provide a hinged positive end stop for positioning the loaf and preventing slice peal-away during slicing and which will then fold flat for compact appliance storage.

(e) to provide a hinged construction to the base housing to facilitate simple and rapid appliance cleaning.

(f) to provide a geometric arrangement that facilitates a simple fold down flat storage configuration.

(g) to provide a built-in spring clip on either side of the appliance that retains the stacked components of the appliance in the stowed configuration.

(h) to provide soft mounting pads at each of the four corners of the base housing such that the device will rest gently on any work surface without danger of sliding or scratching the surface.

(i) to provide an initial screen barrier underneath the support grid to capture the large crumb debris and form the top surface of closure to the base housing, thus preventing an easier path of escape to crumbs that are aspirated into the base housing.

DETAILED DESCRIPTION OF THE INVENTION

As required, detailed features of the subject invention are disclosed herein; however, it is understood that the disclosed features are example in nature relative to this invention and may be embodied in various forms. Therefore, structural and functional details disclosed herein shall not be interpreted as limiting.

Figure 1:
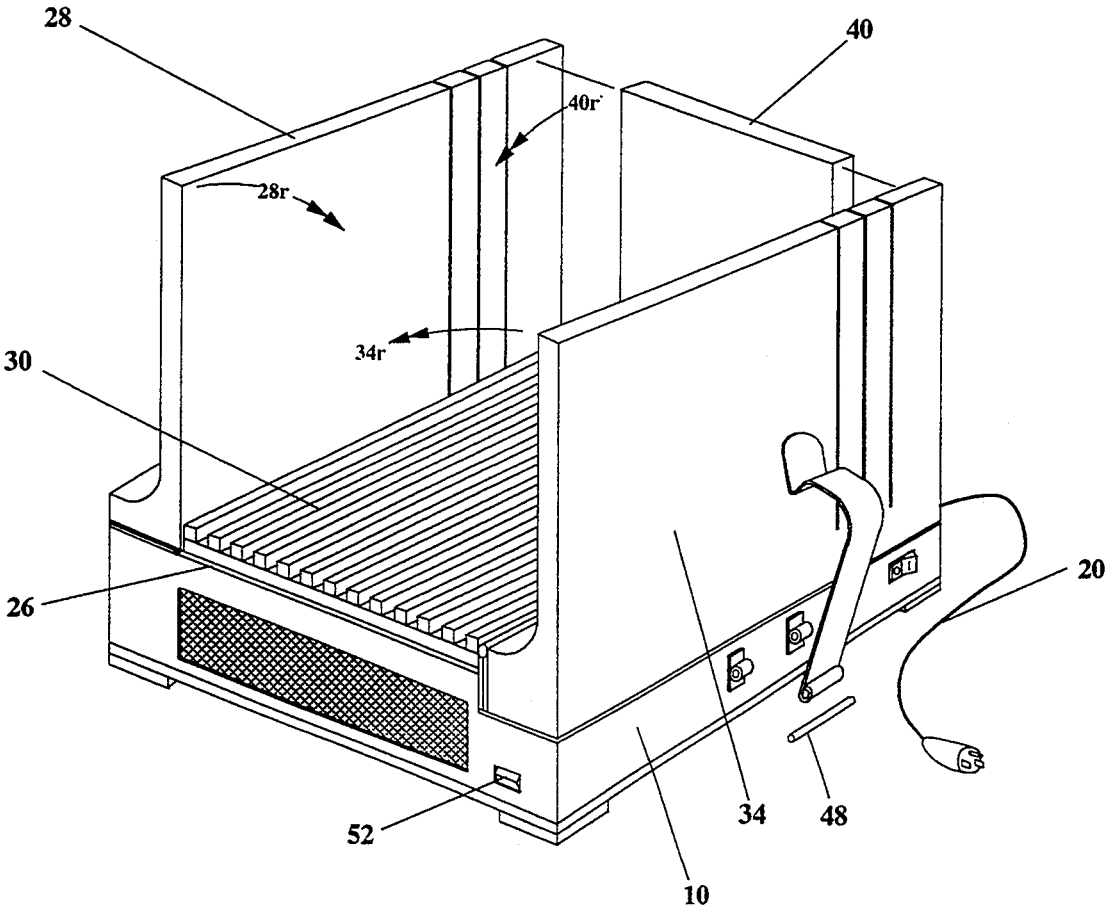
FIG. 1 is a perspective view of the device showing the slicing guides and end stop in place.
Figure 2:
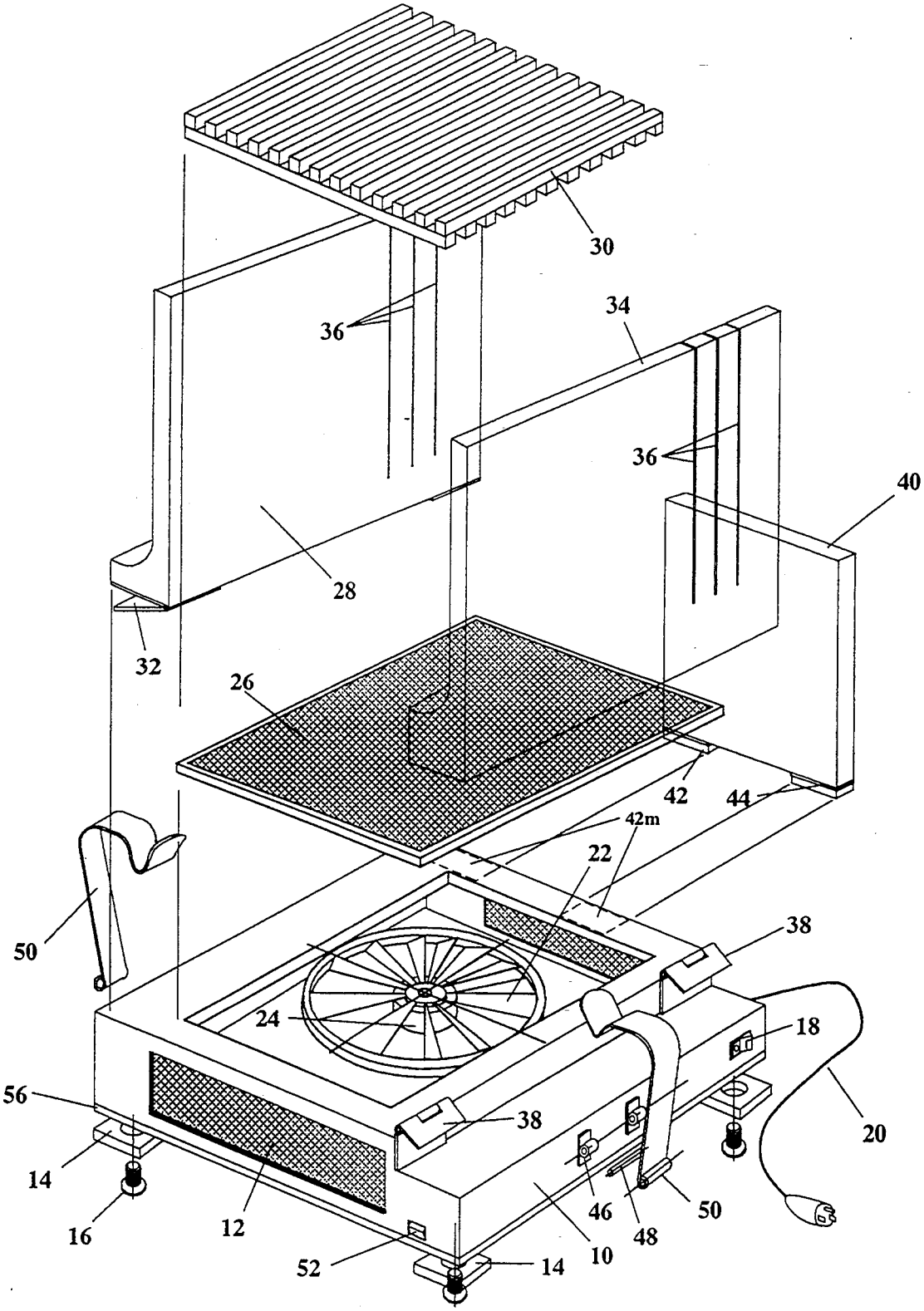
FIG. 2 is an exploded view of the device showing the internal working parts i.e. fan, motor and filter screen.
Figure 3A:
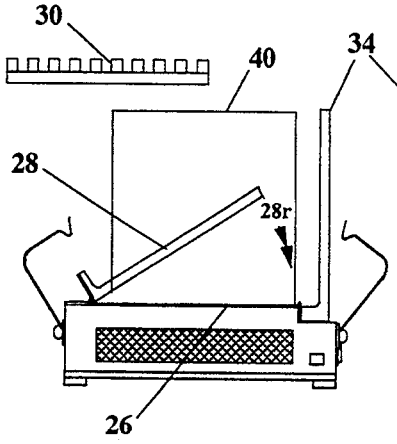
FIG. 3*a–d* are elevational views of the device showing the folding sequence of the major components into a "fold-down" position.
Figure 3B:
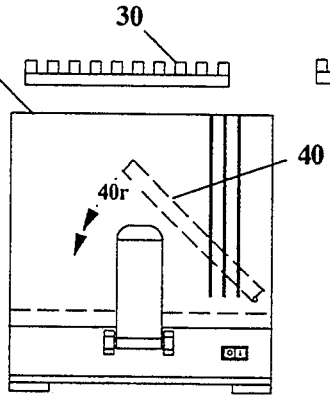
Figure 3C:
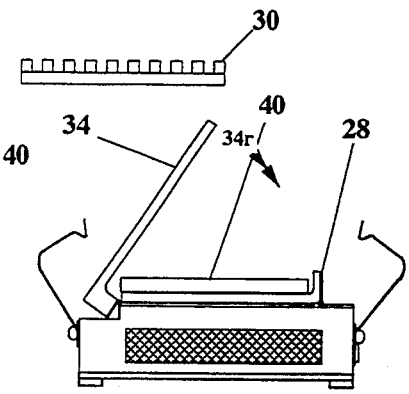
Figure 3D:
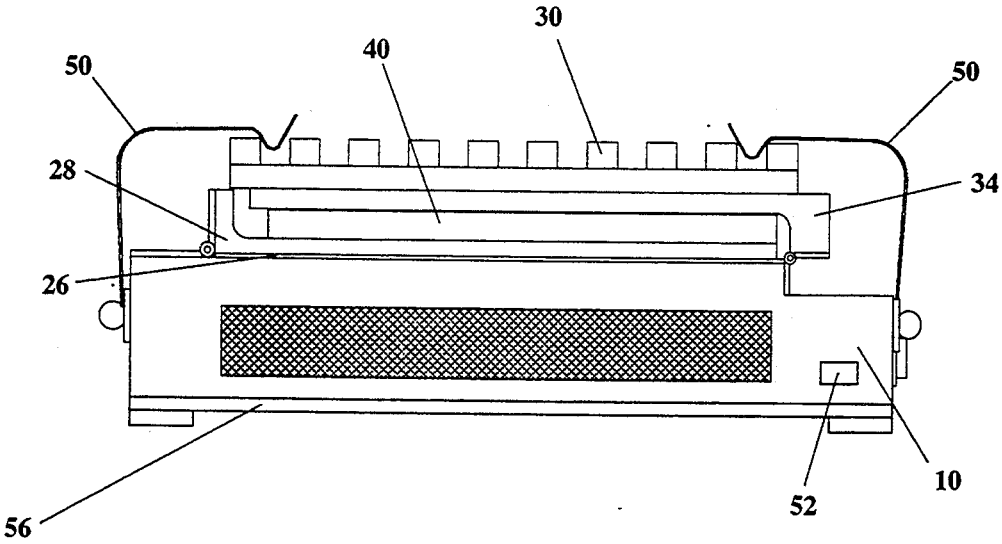
Figure 4:
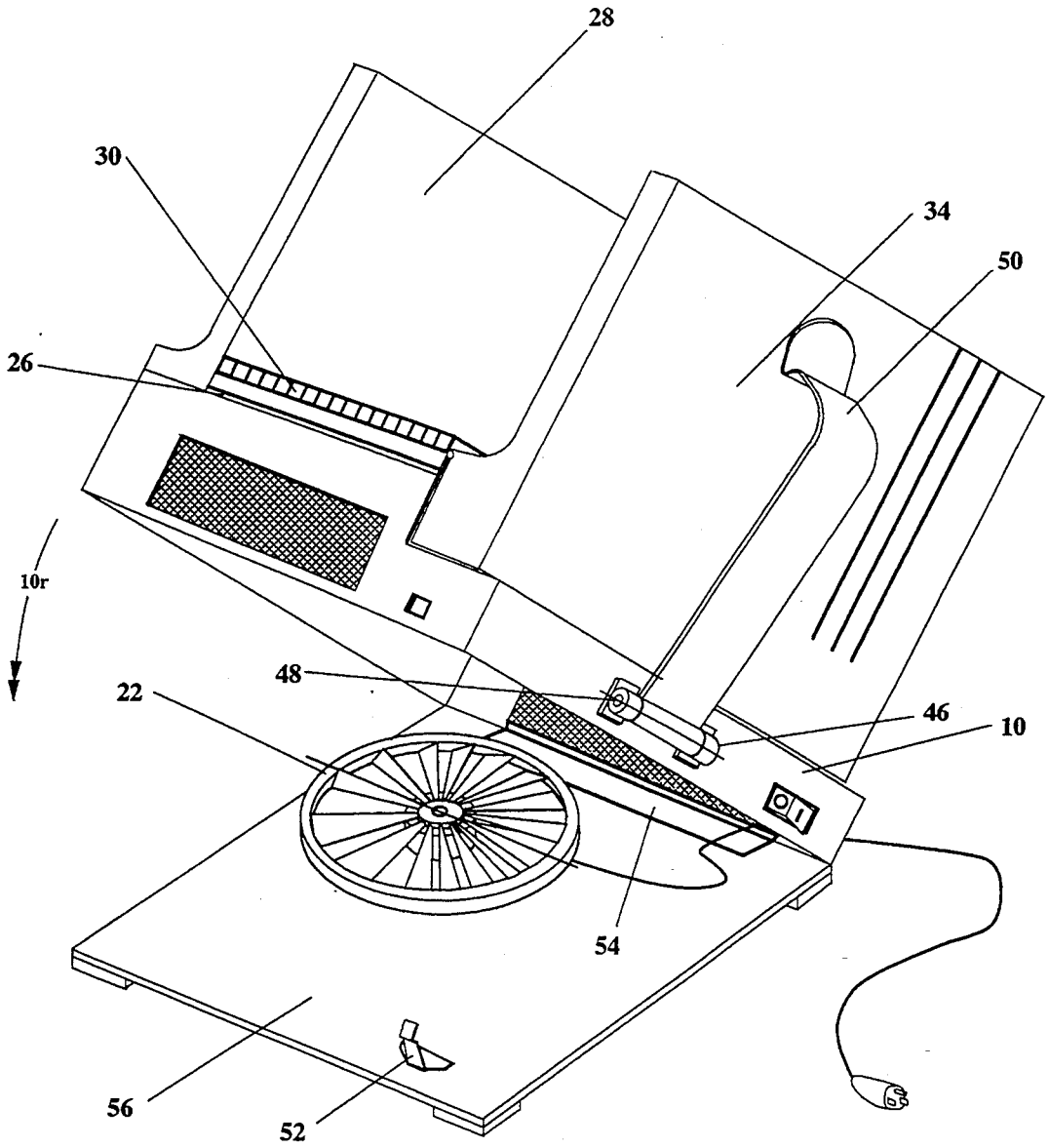
FIG. 4 is a perspective view of the bottom of the device showing the base housing opened for cleaning.

Referring to the drawings in more detail, item 10 the base housing consists of an open topped box with screened vents 12 on two sides and a hinged and latched bottom plate which rests on four soft rubber pads. This base housing contains the motor driven fan and serves as a collection bin for crumb debris during slicing. The two exhaust air vents with filtering screen allow the flow of air from the support grid area above, down and out of the base housing and are adequately sized to prevent pressure buildup in the housing. Items 14 and 16 are the rubber base support pads and attachment screws respectively. The rubber is of a soft, (R30 durometer), silicone formulation that provides non-skid support as well as non-marking performance. The on-off control toggle switch, item 18, controls 110–118 volt power to the electric motor and is mounted on the side of the base housing. This is placed in the on position. Item 20 is the electrical power supply cord that provides 110–118 volt power to the electric fan motor. A standard grounded electrical service plug is provided at the end of the cord. Items 22 and 24 are the aspirating fan and electric drive motor mounted in a vertical position in the base housing. Item 22 is configured in such a way that rotation of the motor provides a downward thrust of air into the base housing. Item 26, the primary filter screen is placed upon the top surface of the base housing and provides initial filtration and capture of crumb debris as well as closure to the base housing. The support grid, item 30, is placed upon the filter screen and provides the resting place for a bread loaf or any other food loaf. Items 28, 34 and 40 are the primary and secondary slicing guides and end stop respectively. Item 28 is hinged by item 32 to the base housing, item 10, in such a way that it becomes rigid when it is pivoted into its upright position and the support grid, item 30, and filter screen, item 26, have been placed in their functional position. Item 34, secondary slicing guide, is hinged by item 38 to the base housing, item 10, in a way that permits lateral pivoting motion 34*r* toward the loaf that is to be sliced thereby trapping and holding the loaf against the primary slicing guide. This pivoting action 34*r* allows tilting of item 34 and lateral holding motion that is necessary to accommodate variable sized bread loaves during slicing. Item 40 is the hinged end stop that positions the loaf in a longitudinal direction during slicing. The hinging is situated such that the end stop becomes vertical and rigid when the filter screen and support grid have been placed in their functional position. Knife guiding slots, items 36 are arranged in the two slicing guides, (28 and 34), such that, when used with the end stop (item 40), 3 equal width portions of bread may be created. Additional slots may be embodied in the slicing guides when additional portions are required on a continuing basis. Items 42 and 44 are the end stop support spacers and end stop hinges respectively. The spacers are required to position the end stop 40 on mounting positions 42*m* at the correct height such that when folded, using item 44 hinges, it will lie flat. Items 46, 48 and 50 are the storage clip hinge pin socket, storage hinge pin and storage spring clip respectively. Two spring clips, item 50, are utilized only when the slicing appliance is configured for storage. They are mounted one on each side of the base housing using items 46 and 48 for attachment and pivoting. The hinge pin socket provides connection to the base housing, item 10, and pivoting capability to the storage spring clip, item 50. Item 50 is shaped in such a way that the uppermost portion "snaps" into a groove embodied in the support grid, item 30. It is this snap fit that provides retention of the components of the device during storage. Also, item 50 is shaped such that an extension protrudes above the support grid, item 30, in such a way as to provide a finger grip and adequate leverage to disengage the clip when desired. Item 48 hinge pin provides pivoting motion to the spring clip, allowing it to swing clear of the working area when the device is in operation. FIG. 3*d* portrays the device in the storage configuration. FIGS. 3*a–c* show the respective pivoting actions 28*r*, 34*r* and 40*r* for folding the primary slicing guide 28, the secondary slicing guide 34, and the end stop 40 into the storage configuration. Notice that the position of the grid, item 30, has been altered to the topmost location such that it will act as the retainer in combination with the spring clips, item 50. Items 52 and 54 are the base housing latch spring and base housing hinge respectively. Item 54's purpose is to allow the base housing upper shell to pivot away 10*r* from the housing base and allow easy cleaning. Item 52 latch spring is placed in such a way that it engages a rectangular opening in the housing upper shell and retains same with the base. The upper housing shell is disengaged by depressing item 52 while at the same time lifting and pivoting the upper shell about hinge item 54.

I claim:

1. A bread slicer appliance comprising:

a. a base housing having an opening in an upper surface and containing an aspirating motorized fan, said opening being covered by a filter screen, whereby the base housing actively draws and collects crumb debris during slicing of a loaf of bread;

b. an open slotted support grid, which rests on top of the base housing and the filter screen, for supporting the loaf during slicing while at the same time allowing free flow of aspirating air and crumbs to the base housing;

c. an upright primary slicing guide including at least one slot therein, said primary slicing guide attached to the base housing and extending along a first side of said support grid and extending upwardly from the base housing providing rigid support to the loaf being sliced as well as guidance for a slicing knife;

d. an upright secondary slicing guide including at least one slot therein, said secondary slicing guide attached to the base housing and extending along a second side of support grid and extending upwardly from the base housing in a direction generally parallel to the primary slicing guide, the slot in the secondary slicing guide being aligned with the slot in the primary slicing guide for simultaneous passage of said slicing knife therethrough; and e. an end stop, also mounted on and extending upwardly from the base housing, providing longitudinal positioning for the loaf and, at the same time, support to the completed slice.

2. The bread slicer appliance of claim 1, wherein the upright primary slicing guide, the upright secondary slicing guide and the end stop are each attached to the base housing by hinges for compact fold down storage capability, the hinges for the upright secondary slicing guide including mounting means for permitting the secondary slicing guide, while in use, to pivot freely toward the upright primary slicing guide and over the supprot grid thus providing a movable lateral clamping support for clamping the loaf.

3. The bread slicer appliance of claim 2 further comprising:

f. two hinged spring clips that are pivotally mounted on opposing sides of the base housing permitting unitized retention of all elements of the invention as a compact folded down unit for storage.

* * * * *